United States Patent [19]

Bernasconi

[11] 4,290,736

[45] Sep. 22, 1981

[54] OIL PUMP HAVING A SUCTION AND PRESSURE PIPE ARRANGEMENT

[75] Inventor: Felix Bernasconi, Zollikerberg, Switzerland

[73] Assignee: BBC Brown, Boveri & Company, Ltd., Baden, Switzerland

[21] Appl. No.: 940,192

[22] Filed: Sep. 7, 1978

[30] Foreign Application Priority Data

Sep. 7, 1977 [CH] Switzerland ..... 10924/77

[51] Int. Cl.[3] ..... F04B 23/14; F04C 2/18

[52] U.S. Cl. ..... 417/87; 138/111; 138/114; 277/135; 417/199 A; 417/572; 418/206; 418/270

[58] Field of Search ..... 417/87, 76, 199 A, 572, 417/172; 418/206, 86, 83, 270; 251/61.1; 137/565; 138/111, 114; 285/133 R, 133 A; 277/135

[56] References Cited

U.S. PATENT DOCUMENTS

| | | | |
|---|---|---|---|
| 263,878 | 9/1882 | Edison | 277/135 X |
| 2,176,322 | 10/1939 | Barrett | 418/133 |
| 2,349,022 | 5/1944 | Ungar et al. | 418/170 |
| 2,954,244 | 9/1960 | Austin | 277/135 |
| 3,837,768 | 9/1974 | Haupt | 418/206 |
| 4,066,386 | 1/1978 | Johnson et al. | 417/199 A |

*Primary Examiner*—Carlton R. Croyle

*Attorney, Agent, or Firm*—Burns, Doane, Swecker & Mathis

[57] ABSTRACT

An oil pump is disclosed having a pressure pipe which is coaxially disposed within a suction pipe to provide a shielding of the pressure pipe. Both the suction pipe and the pressure pipe are arranged parallel to a vertical axis of a housing of the pump. An oil-jet ejector is connected to the interior of the pump housing through openings which provide a continuous venting of the oil flow within the pump. The venting is provided on both the intake and discharge ends of the pump.

1 Claim, 1 Drawing Figure

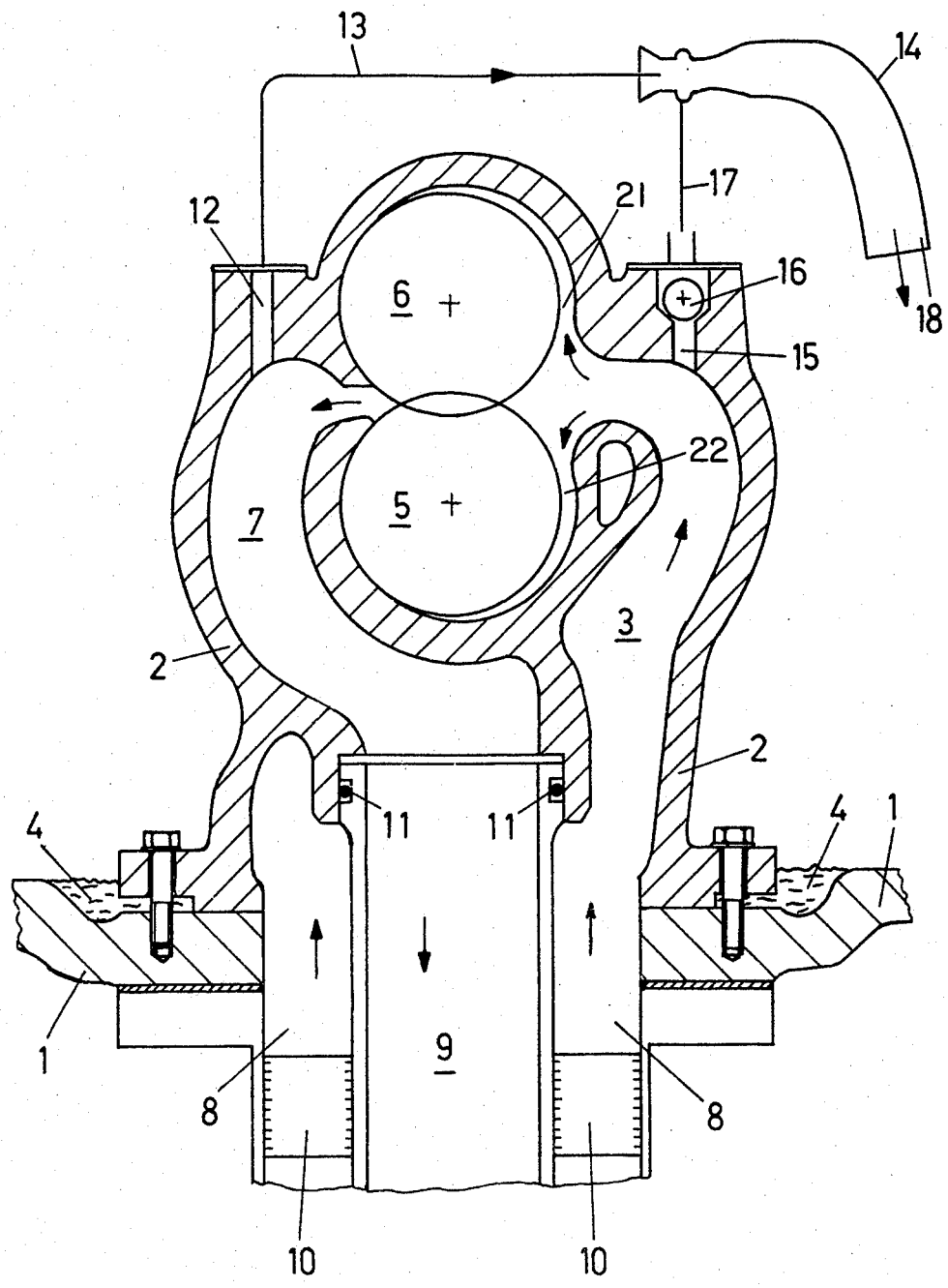
13
14
17
21
12
16
18
15
6
22
5
7
3
2
2
11
11
4
4
1
1
9
8
8
10
10

OIL PUMP HAVING A SUCTION AND PRESSURE PIPE ARRANGEMENT

BACKGROUND AND SUMMARY OF THE INVENTION

The present invention relates to oil pumps, and more particularly to a suction and pressure pipe arrangement for oil pumps.

Pumps having a positive delivery system, such as gear-type rotary pumps, are advantageously used as lubricating oil pumps for turbomachinery especially for steam turbo machines. These pumps, which typically have a great reliability of operation, may be driven by the turbomachinery to deliver oil without substantial difficulty and without the need for an auxiliary drive even at a relatively low speed of rotation of the turbomachinery.

The presence of pressurized lubricating oil pipe lines, however, provides a potential fire hazard. Accordingly, regulations specify that the pressurized lines must be encased by a pipe line which is not under pressure in order to divert any leaking oil to a safe area.

After a turbomachine is shut down, it may take up to one hour for the rotor to stop turning. During the deceleration of the rotor, pressurized oil is being delivered to the turbomachine. In this way, a hazardous condition results if a fire should develop. Therefore, lubricating oil lines, and especially the pressurized pipe line from the oil pump, present sources of danger within the system, since necessary lubricating oil is being supplied to bearing of the turbomachine until the rotor of the turbine actually reaches a standstill.

A known volumetric oil pump uses a foot valve, which is installed in a suction manifold, to supply oil to the turbomachine. An auxiliary oil pump which fills the main oil pump by way of both the suction manifold and a filter subjects the main pump to oil pressure even before the start of the turbo machinery. The foot valve therefore allows the pump to be pressurized prior to the start up of the turbomachine. Accordingly, the suction manifold of a pump having a foot valve can not be considered to provide a non-pressurized shielding.

The difficulties of the known devices have been avoided to some extent by an arrangement in which oil pumps, which are not provided with a foot valve, are filled up by a vacuum pump.

Volumetric gear-driven pumps, as previously known, generally provide a suction lift of from 4 to 6 meters which is obtained by a tooth crown having a peripheral tooth velocity ranging from 8 to 12 meters per second. Such a peripheral tooth velocity results in a relatively high speed for a gear-driven pump. In order to more fully fill the toothed wheels of the oil pump, to avoid damage due to cavitation and to eliminate excessive noise, the pump housings are provided with crescent-shaped intakes at their suction side. Such an arrangement of the intakes, however, in conjunction with the specific configuration of the suction and pressure pipes as well as the oil grooves, does not permit the known oil pump to be used with both a clockwise or a counter-clockwise rotating turbomachine without modifying the connection of the suction and pressure pipes with the pump housing.

It is an object of the present invention to provide an arrangement of suction and pressure pipe connections within an oil pump which can be used with a clockwise as well as a counter clockwise rotating turbomachine.

A further object of the present invention is to provide an oil pump having a pressure pipe line arrangement which prevents oil under pressure from flowing outside the pump housing.

These and other objects are achieved in the pump of the present invention wherein a pressure pipe is arranged inside a suction pipe that is disposed within a housing of the pump.

In the oil pump of the present invention, a pressure pipe is arranged concentrically within a suction pipe so that a vertical symmetrical axis of pinions of the oil pump coincides with a longitudinal axis of the pressure and the suction pipes. Such a concentric arrangement of the pressure pipe within the suction pipe simplifies an alignment of a circular profile of the suction pipe with the intake area of the suction duct, which is usually designed in rectangular shape and that leads to the toothed gear of the pump. By having the symmetrical axis of the oil pump coincide with the longitudinal axis of the pressure and suction pipes it is possible to use the pump with a turbomachine which rotates clockwise as well as with a turbomachine which rotates counter-clockwise.

In accordance with a further object of the invention, the oil pump may be vented by having a connection lead from a pressure chamber of the oil pump to an oil-jet ejector. A suction chamber of the pump is then connected to the oil-jet ejector by means of a venting pipe and a check valve.

In accordance with a still further object of the present invention an oil sump which is supplied by the jet ejector is provided between a base support and the suction pipe. Since the oil sump is always filled with oil and since the suction pipe of the oil pump is mounted directly onto the base support with a metal contact and without the use of a gasket, the possibility that the oil pump will draw in air as a result of leakages is greatly reduced or eliminated.

BRIEF DESCRIPTION OF THE DRAWING

A preferred embodiment of the present invention is shown in the drawing which is a cross-sectional view of the oil pump of the present invention mounted on a base, with the suction and pressure pipes of the pump extending into the base.

DETAILED DESCRIPTION OF THE PREFERRED EMBODIMENT

With reference to the single drawing, a base 1 is fastened, preferably by bolting, to a pump housing 2. The pump housing 2 forms the outer wall of a suction chamber 3 at the suction side of the oil pump. A joint between the pump housing 2 and the base 1 is sealed by an oil sump 4 which surrounds the base of the oil pump. This sump 4 prevents the oil pump from drawing in air in the event of a leakage through a metallic seal between the pump housing 2 and the base 1. Otherwise, no auxiliary sealing means are employed.

Within the pump housing 2 are arranged a pair of pump elements 5 and 6, which are preferably toothed wheels that deliver oil by a positive action. The elements 5 and 6 preferably have a gently sloped helical gear configuration to reduce pulsations in the delivery of oil which could arise due to a small number of teeth provided for the pump elements. Typically only one of the two pump elements 5,6 or toothed wheels is directly driven by a pinion of a turbine shaft so as to drive the oil pump at approximately 2,000 to 5,000 r.p.m., delivering 30 to 300 liters per second of oil.

An upper portion of the suction chamber 3 forms a duct which leads to the pump elements 5 and 6. The elements 5 and 6 then communicate with a pressure chamber 7. An entrance of the suction chamber 3 communicates with a suction pipe 8. A pressure pipe 9 which leads from the pressure chamber 7 into the oil circulating system is concentrically arranged within the suction pipe 8. The pressure pipe 9 is attached to an oulet of the pressure chamber 7 and is retained within the suction pipe 8 by means of a plurality of supports 10. A sealing ring 11 seals the pressure pipe against the suction pipe. The cross section of the suction pipe 8 changes within the pump housing 2 so as to have a rectangular intake cross-sectional area which leads to the suction chamber 3. The intake region 21,22 of the suction chamber 3 is substantially crescent-shaped in order to insure a more efficient filling of the teeth of the pump elements 5, 6.

Within the pressure chamber 7 there is provided a discharge orifice 12 which communicates with an oil-jet ejector 14 by means of a pipe line 13. The suction chamber 3 communicates with the oil-jet ejector 14 by means of a pipe line 17 having an aperture 15 which is closed by a one-way valve 16. In this way, a continuous venting of the suction chamber 3 is provided.

The oil-jet ejector 14 has a discharge orifice 18 having a greatly widened passageway relative to the cross-sectional area of the entrance of the pipe line 13. The ejector oil is accordingly discharged through the ejector to the oil sump 4 at a low velocity. A continuous suction by the oil ejector 14 will insure that the oil reaching the bearings is substantially free of air.

The oil-jet ejector can also be readily integrated into the pump housing 2, with the pipe lines 13 and 17 being included in the pump housing 2. It is considered to be well known (and accordingly not illustrated) that the suction pipe 8 extends into an oil tank area and that the pressure pipe 9 extends into an oil circulating system of the turbine The oil pump of the present invention has a particular advantage in that the oil flow is confined to the pump housing either in the event of a leak in the pressure pipe line or in the event of a shut-down of the turbo-machine due to a fire. During the period of time when the oil pump continues to operate to provide journal bearings of the turbine with lubrication during shut-down, oil under pressure is contained within the housing and therefore does not reach the outside of the pump housing to thereby intensify the fire.

The concentric arrangement of the suction and pressure pipes and the alignment with the vertical axis of the pump housing permits the pump to be used with turbomachines which rotate either clockwise or counterclockwise. Aligning the pipes along the pump axis allows the pump to be mounted for use in either direction of turbine rotation without modifying the connection between the pump housing and the pipes. When used with a turbine which rotates clockwise, for example, the pump housing is rotated 180° with respect to the alignment of the housing when used with a turbine which rotates counterclockwise.

The principles, preferred embodiments and manner of operation of the present invention have been described in the foregoing specification. The invention which is intended to be protected is not, however, to be construed as limited to the particular forms disclosed, as these are illustrative rather than restrictive examples. Variations and changes may be made by those skilled in the art without departing from the spirit and scope of the present invention.

What is claimed is:

1. A driven oil pump, of the type which is preferably driven only in one direction, comprising:

a housing mounted on a base;

a pair of rotatable pump elements provided within the housing and having an intake side and a discharge side;

a suction chamber communicating with the intake side of the pump elements, the suction chamber being substantially within the housing and having substantially crescent-shaped portions at the intake side of the rotatable pump elements;

a pressure chamber communicating with the discharge side of the pump elements, the pressure chamber being substantially within the housing;

a suction pipe communicating with the suction chamber;

a pressure pipe communicating with the pressure chamber and concentrically disposed within the suction pipe such that a longitudinal axis of the pressure pipe intersects a rotational axis of each of the pump elements whereby the pump accommodates an opposite driving direction by a 180° turn of said housing around the longitudinal axis of the pressure pipe;

venting means for venting the suction chamber; and an oil sump which communicates with the base and the housing at the location of mounting to provide a seal between the housing and the base, and wherein the venting means vents to the oil sump.

* * * * *